US007092543B1

(12) United States Patent
Mahoney et al.

(10) Patent No.: US 7,092,543 B1
(45) **Date of Patent: *Aug. 15, 2006**

(54) ONE-SIZE-FITS-ALL UNI-EAR HEARING INSTRUMENT

(75) Inventors: Derek D. Mahoney, Manalapan, NJ (US); Walter P. Sjursen, Washington Crossing, PA (US); Wayne J. Staab, Phoenix, AZ (US); Marvin Leedom, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/524,040

(22) Filed: Mar. 13, 2000

Related U.S. Application Data

(60) Provisional application No. 60/145,410, filed on Jul. 23, 1999.

(51) Int. Cl.
*H04R 25/00* (2006.01)

(52) U.S. Cl. ..... 381/328; 381/323; 381/322

(58) Field of Classification Search ..... 381/322, 381/328, 326, 380, 324, 312, 314
See application file for complete search history.

(56) References Cited

U.S. PATENT DOCUMENTS

| | | | | |
|---|---|---|---|---|
| 2,487,698 A | | 11/1949 | Bishofberger | 172/36 |
| 3,080,011 A | | 3/1963 | Henderson | 181/23 |
| 4,739,512 A | | 4/1988 | Hartl et al. | 381/68.6 |
| 4,834,211 A | | 5/1989 | Bibby et al. | 181/135 |
| 4,870,688 A | | 9/1989 | Voroba et al. | 381/60 |
| 5,185,802 A | | 2/1993 | Stanton | 381/68.6 |
| 5,201,007 A | | 4/1993 | Ward et al. | 381/68.6 |
| 5,487,012 A | | 1/1996 | Topholm et al. | 364/474.05 |
| 5,701,348 A | * | 12/1997 | Shennib et al. | 381/328 |
| 5,742,692 A | | 4/1998 | Garcia et al. | 381/68.6 |
| 5,825,896 A | * | 10/1998 | Leedom | 381/322 |
| 6,205,227 B1 | * | 3/2001 | Mahoney et al. | 381/328 |
| 6,359,993 B1 | | 3/2002 | Brimhall | |
| 6,438,244 B1 | * | 8/2002 | Juneau et al. | 381/322 |
| 6,532,295 B1 | * | 3/2003 | Brimhall et al. | 381/328 |

FOREIGN PATENT DOCUMENTS

| | | |
|---|---|---|
| GB | 2155276 | 9/1985 |
| WO | WO 9325053 | 12/1993 |
| WO | WO 95/15067 | 6/1995 |
| WO | WO 99/07182 | 2/1999 |
| WO | WO 99/39548 | 8/1999 |

* cited by examiner

*Primary Examiner*—Curtis Kuntz
*Assistant Examiner*—Tuan Duc Nguyen
(74) *Attorney, Agent, or Firm*—Hamilton, Brook, Smith & Reynolds, P.C.

(57) ABSTRACT

A one-size-fits-all uni-hearing aid is described which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

10 Claims, 6 Drawing Sheets

RANGE = 23mm to 34mm
MEAN = 28.29mm (TOP LOOKING DOWN)

LENGTH IN mm AS INDICATED IN DRAWING BELOW

| LEFT | RIGHT |
|---|---|
| 33 | 28 |
| 31 | 30 |
| 26 | 28 |
| 30 | 23 |
| 27 | 33 |
| 26 | 27 |
| 27 | 29 |
| 27 | 27 |
| 26 | 31 |
| 25 | 26 |
| 30 | 30 |
| 30 | 25 |
| 26 | 28 |
| 26 | 29 |
| 33 | 34 |
| 30 | 29 |
| | 26 |
| | 30 |
| | 27 |
| | 25 |
| | 28 |
| | 29 |

AVERAGE = 28.29mm

AVERAGE: LEFT EAR 28.31mm RIGHT EAR 28.27mm

ONE-SIZE-FITS-ALL UNI-EAR HEARING INSTRUMENT

RELATED APPLICATION

This application claims the benefit under 35 U.S.C. 119(e) of U.S. Provisional Application No. 60/145,410, filed Jul. 23, 1999, the entire teachings of which are incorporated herein by reference.

This application is related to copending U.S. applications:

| ATTORNEY DOCKET NO. | TITLE |
|---|---|
| 09/524666 | Disposable Modular Hearing Aid |
| 09/524043 | Mass Produced Hearing Aid With a Limited Set of Acoustical Formats |
| 09/524501 | Hearing Aid |
| 60/188997 | Hearing Aid With Flexible Shell |
| 60/188996 | Hearing Aid Prescription Selector |
| 60/188721 | Through-Hole and Surface Mount Technologies for Highly-Automatable Hearing Aid Receivers |
| 60/188857 | Remote Programming and Control Means for a Hearing Aid |

all filed of even date herewith, the entire teachings of which are incorporated herein by reference.

BACKGROUND OF THE INVENTION

The invention herein generally relates to a miniature electroacoustic instrument and, in particular, a peritympanic hearing instrument suitable for use in humans.

Hearing instruments typically are custom-designed to suit the anatomical and audiological needs of an individual user. Because custom-made devices can be very costly, it is desirable to mass-produce a hearing instrument that is relatively inexpensive and is readily adaptable to most users' anatomical and audiological requirements, and which is inconspicuous and lightweight.

There are significant challenges associated with the development of mass-produced hearing instruments. Although the structure of the external auditory canal generally is a sinuous, oval cylinder with three sections, it can vary significantly depending on the particular individual. Traversing the outer canal towards the inner tympanic membrane, the first section is directed inward, forward, and slightly upward. The next section tends to pass inward and backward. The final section is carried inward, forward, and slightly downward. The outer portion of the ear canal is surrounded by cartilaginous tissue, with the inner portion being surrounded by bone. The canal is formed with a very thin lining of skin, which is extremely sensitive to the presence of foreign objects. Further details of the path and contours of the external auditory canal are described in U.S. Pat. No. 4,870,688, issued to Barry Voroba et al., and in U.S. Pat. No. 5,701,348, issued to Adnan Shennib, both of which are incorporated herein by reference.

U.S. Pat. No. 4,870,688 describes an in-the-canal miniaturized hearing aid contained within a prefabricated ear shell assembly composed of a hollow rigid body with a soft, resilient covering fixed to its exterior. The microphone, receiver, amplifier, and battery are all wholly contained within a prefabricated modular sound assembly which snaps into a patient-selectable prefabricated ear shell assembly. The soft, resilient covering that is affixed to the exterior of the rigid core is intended to allow the cylindrical or elliptical shape of the in-the-canal hearing aid to more easily conform to the individual variations in a user's auditory canal.

U.S. Pat. No. 5,701,348 described a hearing device having highly articulated, non-contiguous parts including a receiver module for delivering acoustic signals, a main module containing all of the hearing aid components except the receiver, and a connector that is articulated with both the receiver module and the main module to permit independent movement of the receiver and main modules. Separation of the receiver from the main module, and the receiver's articulation with respect to the main module, is intended to provide at least two degrees of freedom in movement and independent movement of the receiver module with respect to the main module, and visa versa.

Attempts have also been made to provide inserts intended to be used as a part of a hearing aid device. U.S. Pat. No. 2,487,038, issued to Jasper Baum, describes an ear insert shaped for insertion into the concha or the outer cavity of an ear. It includes a series of ball-shaped ball-like wall sections each made with sufficiently thick walls so as to give them great stiffness and prevent substantial distortion of the cross-section of the sound-passage portions extending therethrough under the action of external bending forces when the insert is inserted into the curved space of the outer ear cavity. The ball-like wall sections are interconnected by short neck-like sections to readily flex and take up substantially the entire deformation to which the channel insert is subjected. Thin flexible, skirt-like protrusions in outward and rearward directions from the ball-like wall sections to become wedged against the surrounding surface portions of the outer ear cavity for automatically establishing therewith an acoustic seal.

U.S. Pat. No. 3,080,011, issued to John D. Henderson, describes an ear canal insert with a very soft tip with flanges. A flexible mounting tube is considerably stiffer than the material of which the head portion flanges are formed so that it can be used to force the insert portion of the device into the ear canal.

U.S. Pat. No. 5,201,007, issued to Gary L. Ward et al., describes earmolds that convey amplified sound from the hearing aid to the ear. An acoustic conduction tube extends into the ear canal and a flanged tip on the conduction tube creates a resonant cavity between the tip and the tympanic membrane. The tip is constructed of a flexible material to form a sealed cavity adjacent the tympanic membrane, permit the seal to be obtained with only slight pressure against the wall of the ear canal, and permit the tip to be oscillated by the natural, unamplified sounds which arrive by air conduction through the ear canal, so that the oscillation can raise the resonant frequencies of the cavity.

U.S. Pat. No. 5,185,802, issued to Mark F. Stanton, describes a modular hearing aid system comprising a customized exterior shell formed of compliant material, in situ, in the usual manner in accordance with the shape of the ear canal of the individual user, such that a separate and distinct shell is required for each ear. A housing containing the hearing aid components is removably inserted in the shell. The housing has a bilateral standardized shape so it can be used with either a right or left ear customized shell.

SUMMARY OF THE INVENTION

Despite numerous attempts including those described above, there remains a need for a mass-produced hearing instrument that is relatively inexpensive, readily adaptable to an individual's anatomical and audiological requirements, and that is inconspicuous and lightweight. It has been discovered that the development of a prosthetic device that occupies the region traditionally filled by an in-the-canal (ITC) or completely in-the-canal (CIC) device, as well as extending significantly into the peritympanic region, is improbable at best without a device that will allow deep penetration into the ear canal by the hearing instrument. Current "one-size-fits-all" hearing instruments are either of the in-the-ear (ITE) or ITC or CIC variety. Some have the ability to accommodate the first bend in the ear canal. However, conventional hearing instruments fail to adequately and simultaneously accommodate the first and second bends of a typical ear canal and are generally not capable of comfortably extending significantly into the peritympanic region.

Copending U.S. application Ser. No. 09/105,729 entitled "Peritympanic Hearing Instrument" filed Jun. 26, 1998 and incorporated herein in its entirety by reference attempts to fulfill many of the requirements for an acceptable "one-size-fits-all" hearing aid. The referenced application discloses a hearing instrument that is positionable in the external auditory canal of a human at a location that is proximal to the tympanic membrane. The instrument includes a substantially rigid shell that is shaped to enclose a microphone, electronics, as well as receiver with a distal end portion that faces the tympanic membrane. The instrument is provided with a flexible tip member that is connected adjacent to the distal end portion of the shell.

Like the above referenced copending application, the present invention provides a functional hearing aid body with a suitable shape capable of being located proximately adjacent the tympanic membrane and within the inner canal. However, the shape is formed so that not only is the body capable of being comfortably inserted and left in position in the ear of a "typical user" such that "one-size-fits-all" but one size also fits either the left or right ear, i.e. a "uni-ear" or "non-specific" hearing aid device. Moreover, there is no need to customize the outer shell or to provide a soft compliant, in situ, formed outer mold around the shell.

Note: For purposes of this application, a "typical user" is considered to be a person whose inner canal profile conforms substantially to a profile determined by obtaining impressions from a statistically valid population of potential users.

In addition, a method and apparatus is provided for forming such a structure which includes "inter alia" the following procedures:

First, a plurality of sample ear impressions are taken from the general populace. Next, topological data is generated from the ear impressions. This can be accomplished by well-known three-dimensional scanning, cross-sectioning or a similar technology. The data is then processed using generally a available solid modeling software packages to mathematically generate volume dimensions representing the ear impressions. Next, the dimensions are properly oriented and aligned by the software user and a single new set of volume dimensions is created which represents the intersection of all the sampled impressions. This single new set of volume dimensions is then manipulated using the software to smooth and truncate the shape so as to produce a "one-size-fits-all" shape (either the left or right ear shape but not both). Next, a mirror image of the one-size-fits-all shape is generated to produce a "mirror image" shape. Data representing the original and mirror image shapes or volumes is then processed as above to create a uni-shape which after minor smoothing and radiusing operations produces a mold for a "uni-ear" hearing aid device.

Preferably, the mold is used to produce two shell halves with interior cores for housing the essential hearing aid parts, such as, the microphone, electronics, battery and speaker (receiver). In addition, the molded body is adapted to retain a soft tip at an appropriate angle proximal to the tympanic membrane. This tip couples sound from the hearing aid receiver to the tympanic membrane and also serves to enhance retention of the hearing aid in the inner canal without compromising insertion capability at a distal end of the hearing aid.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
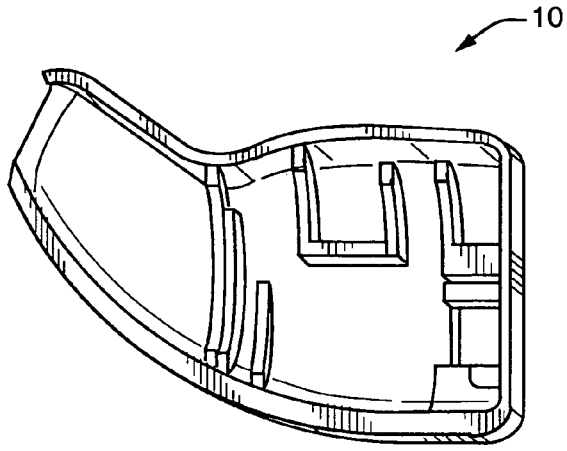
FIG. 1 is a side view of an embodiment of a half shell of a body for a "one-size-fits-all" "uni-ear" hearing instrument.

A description of preferred embodiments of the invention follows.

The invention will now be described with reference to several embodiments selected for illustration. It will be appreciated that the invention is not limited to the specific embodiments shown in the drawings or described herein. The following description is not intended to limit the scope or spirit of the invention, which is defined separately in the appended claims.

The traditional process of fitting a patient with a hearing instrument involves a fairly long and cumbersome process. This procedure sequentially requires (1) that testing be done to quantify the spectral and intensity characteristics of one's hearing loss, (2) the generation of custom ear impressions for each ear to be fitted with an aid, (3) fabrication of custom hearing instruments using the ear impressions as templates, and (4) possibly the modification of these parts to obtain an acceptable fit. The typical time scale for this entire process is about two weeks. A goal of the present invention is to eliminate steps (2) through (4) above, so that patients may be fitted with hearing instruments in less than an hour.

To this end, a "one-size-fits-all" peritympanic (deep canal fitting) uni-hearing aid instrument has been developed in accordance with the invention. The primary obstacles impeding these goals were the plethora of shapes, sizes, and curvatures of various ear canals. The present invention provides a hearing instrument that comprises a semi-rigid body shaped so as to accommodate the first (outermost) bend in the ear canal, coupled with a flexible tip capable of traversing the first bend and subsequently, conforming to the second bend. Initially, these requirements result in two shapes; a "one-size-fits-all" unit for either the left ear or right ear. Next, by forming a mirror image of the shape of one of the units, a single shape for a hearing instrument can be generated as described below which will fit in either ear, i.e. a "one-size-fits all" uni-ear device.

In general, the process begins by gathering many (100 or more) ear impressions that are representative of the (target) population. It is not necessary to collect both left and right ear samples since either will suffice. Topological data is then obtained by employing three-dimensional scanning, cross-sectioning, or equivalent methods. The topological data is then transferred to a solid modeling software package so that volumes representing the scanned ear impressions are created. Once the volume dimensions have been properly oriented and aligned, a new volume dimension is created that is the intersection of all the prior dimensions. The single resultant dimension is then truncated and smoothed, and is now suitable for use in one ear only (e.g., either a left-ear or right ear unit).

It was observed that the single-ear units created in the manner detailed above exhibit a considerable amount of mirror symmetry. In fact, this symmetry is lost only at that distal end of the hearing aid near the outer region of the ear canal. Thus, to obtain a uni-ear device, it was determined that one could (using solid modeling software) create a mirror image of the single left or right hearing instrument body and then align and intersect these two bodies, i.e., the original and the mirror image dimensions. These two entities were found to have a relatively large overlap. After some minor smoothing (used to minimize the visual impact) and radiusing operations, the set of volume dimensions that results from the prior intersection may be used to contain a uni-ear device when coupled with a flexible distal tip to fit deeply into the ear canal.

Figure 2:
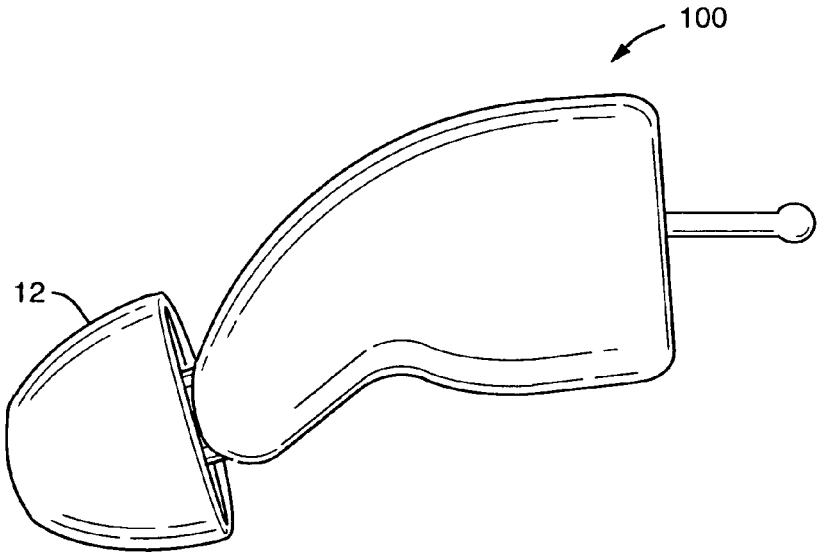
FIG. 2 is a perspective view of an embodiment of a complete hearing instrument formed by two half shells of FIG. 1 plus a flexible tip.

A method for fabricating hearing aid bodies having the desired shape is to produce two semi-rigid half shells 110, one of which is shown in FIG. 1. Joining the shells results in a single rigid body 100 as shown in the perspective of FIG. 2. Note that this shell 10 has features that are adapted to contain internal components such as a microphone, battery, and a receiver, etc. (not shown). In one embodiment, the shell may contain a permanently wired-in battery as disclosed in copending patent application Ser. No. 09/263,593, filed Mar. 5, 1999 entitled "Disposable Hearing Aid with Integral Power Source" (incorporated herein in its entirety by reference) such that the hearing aid is not readily repairable, rather it is intended to be disposable after its useful life. Another important pertinent attribute of the finished shell is that it is shaped to fit either ear for most people. The body 100, as shown in FIG. 2, of the hearing instrument is also adapted to hold a soft tip 12 at a relative angle to enhance retention of the unit in the ear without compromising insertion.

The following sections outline one possible procedure for making a mold for a "uni-ear" device.

1. Ear Inspection

The first step is to collect a plurality of ear impressions of a representative target population. Before making an impression the ear should be inspected. To properly inspect the ear, the pinna is grasped between the thumb and index finger and gently pulled back and slightly up. This action straightens the canal to facilitate the placement of an otoscope into the canal. In working with children, it is generally suggested that the pinna be pulled slightly down and back.

The ear is inspected for any discharging condition. If there is any discharge in the ear, the person inspected should be seen by an ear physician, and no ear impression should be made. Also, inspect for irregularities in the canal, foreign objects, or for any other contraindications, including excessive cerumen. If there is an obstruction, the person should be referred to a physician. To assure a good impression, note the following: (1) size of canal—to determine the size of the ear impression, (2) the texture of ear and canal—with very soft ears, it is easy to distort the impression when putting the material into the canal and ear, (3) angle and direction of canal—it is important that the impression is a true and complete picture of the ear canal, (4) canal length—the canal of the ear impression must be long enough to direct sound to the eardrum (this would be past the second directional turn).

2. Preparing the Canal

Figure 3:
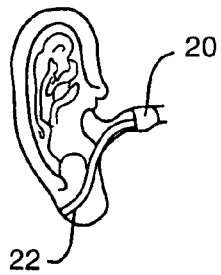
FIG. 3 is a cutaway view of an ear showing a detail of a block used in the process of forming an ear impression.

Before injecting the impression material into the canal, a block 20 must be inserted to a location proximal to the tympanic membrane as depicted in FIG. 3. A foam block or cotton block 20 of the proper size as determined from the ear inspection should be used. Be sure that a thread or dental floss 22 is securely attached to the block. Insert the block into the canal. It is generally a good idea to guide the block into the canal with an ear light. Always support the hand with the ear light to prevent any injury if there should be any rapid head movement. Insert the block to a sufficient depth to allow the impression to include the second directional bend in order to direct the sound to the tympanic membrane. An ear block 20 is required for making all impressions as it (1) protects the eardrum from damage, (2) blocks material and allows it to expand to fill the whole canal, and (3) assures a complete canal with the proper final bend. In some instances, it may be necessary to trim excessive hair in the canal. Be sure to use blunt tipped scissors to reduce the possibility of injury to the ear.

3. Making the Impressions

1. Always prepare the materials in advance.
2. Follow the mixing instructions for the material in use.
3. With powder-liquid materials, mix with a spatula until a smooth creamy consistency is reached and the material has begun to congeal. With solid materials, knead equal amounts of both components until colors are evenly blended.
4. Working rapidly, place the material in the proper syringe. Press the plunger forward until a small amount of material is ejected.
5. With the canal block 20 in the ear, place the nozzle tip of the syringe in the opening to the ear canal. Be sure to support your hand to avoid any injury in the event of any rapid heard movement. Press the plunger gently, gradually withdrawing the syringe as the material fills the canal and begins to flow out into the concha and helix areas. Be sure to fill the entire outer ear, especially the helix area, and keep the nozzle submerged in the material at all times for better filling and completeness of the total impression.

6. After the canal and outer ear are completely filled, apply only slight pressure on the outer surface of the impression to smooth for mailing purposes.
7. Allow sufficient time for the impression to set. Ten minutes is the minimum time recommended. Check by making an indention with the thumb nail. If properly set up, no mark should remain.
8. Gently break the seal at as many points as possible to prevent distortion and reduce stress when removing the impression.
9. Grasp the pinna firmly with one hand the impression with the other, rotate it slowly with an upward and outward motion. The canal block should remain an integral part of the impression.
10. Reinspect the canal with an otoscope after removal to be sure the ear is clear.

4. Examining the Impressions

After removal of the impression, critically evaluate all areas for accuracy. If the impression does not represent a true picture of the ear, the best time to make a second impression is now. In the long run, it will save time in modifications and remakes.

Figure 4:
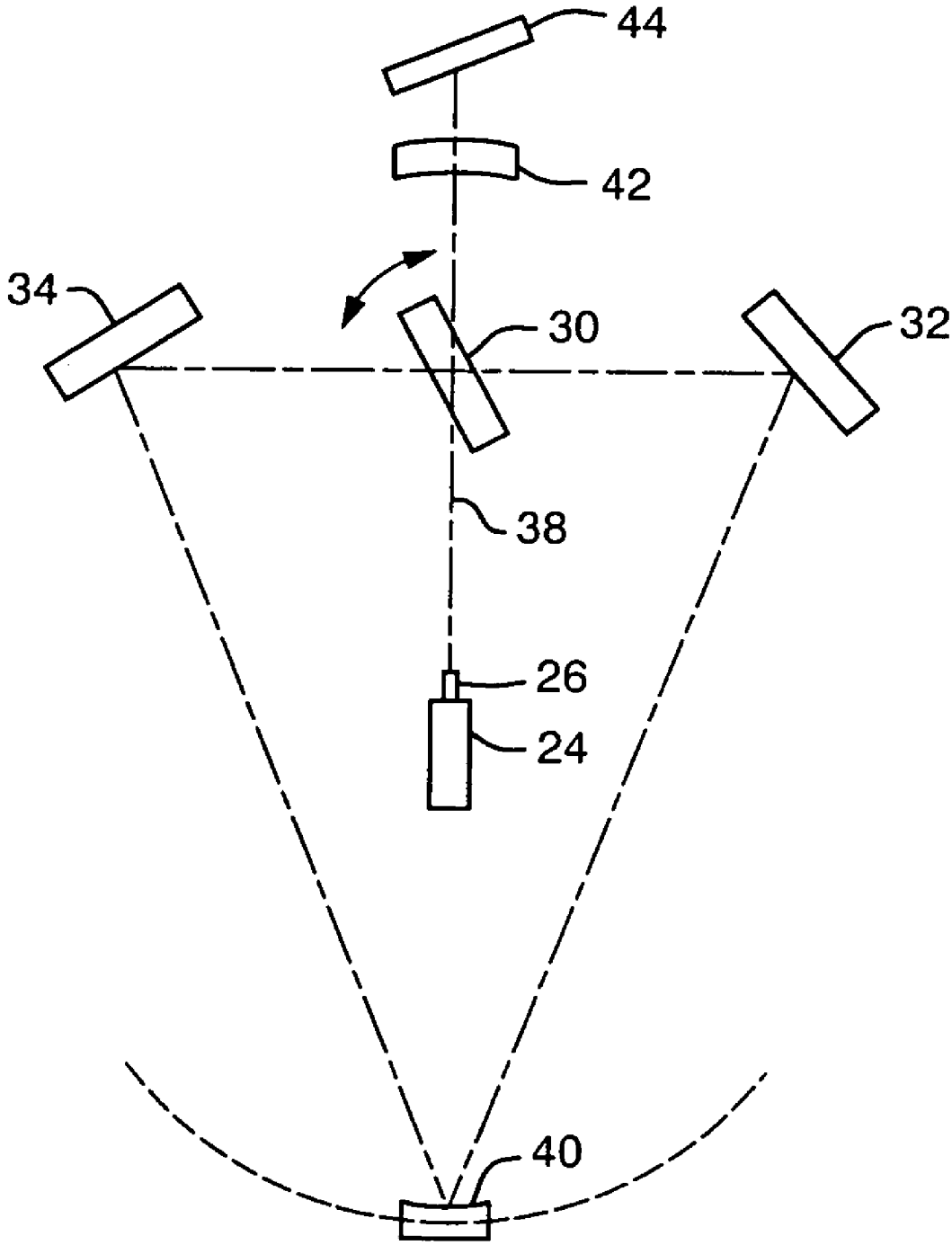
FIG. 4 is a schematic of synchronized scanning method used to generate topological data from ear impressions.

5. Generating Topological Data from the Ear Impressions Using 3D Scanning 3D scanning of the ear impressions are implemented as follows:

Synchronized scanning geometry, based on a doubled-sided mirror (used to project and detect a focused or collimated laser beam) as shown in FIG. 4 is used for this purpose. A light source such as a laser 24 is coupled to an optical fiber 26. A scanning mirror 30 and fixed mirrors 32, 34 are used to project the laser beam 38 on the impression 40. The scattered light is collected through the same scanning mirror 30 and projected and focused by lens 42 onto a linear CCD array 44. Note that the CCD 44 is tilted to compensate for defocusing at the detection site. With careful optical design, the divergence of the laser beam can be made to match the resolving element field of view of the CCD linear array 44. In such conditions, the parameters of the focused laser beam are kept constant over a large depth of view. This enables 3-D digitizing of the impressions 40 from a very short distance (10's of cm) to a large distance (10 meters) without refocusing or processing algorithm modifications. The configuration illustrated in FIG. 4 is a profile measurement device. A second scanning mirror (not shown) is used to deflect orthogonally both the projected and the reflected laser light. The whole arrangement can be mechanically translated by commercially available gantry linear positioning device or by rotary table. A typical large field of view 3-D laser scanner uses two orthogonal galvanometers to address a 4000 pixel by 4000 pixel field of view. This optical configuration allows 3-D recordings from 50 cm to 10 m from the scanner using a linear CCD array as a position sensor. The minimum element of resolution of the CCD corresponds to a resolution in depth of 100 microns at 50 cm, and approximately increases as the square of the distance.

An alternative relatively inexpensive method for obtaining 3D scans of ear impressions utilizes cameras. For example, 3Scan (from Geometrix, Inc.) can be used to replace the expensive laser scanning hardware of FIG. 4 with a low-cost digital camera. The computer-controlled camera takes multiple images of an object rotating on a computer-controlled turntable. From these images, 3Scan software extracts the complete 3D geometry of the object and maps textures from the original imagery onto the geometry. User-selectable polygon decimation supports the output of model complexities from 100 polygons to 1,000,000 polygons in a variety of industry standard file formats.

6. Transferring the Data into the Solid Modeling Software

The scanning tools described above generate data representing the shape of the surfaces of many ear impressions that have been scanned. This information is called "cloud point" data. This cloud point data is subsequently "read" into a software package such as "Pro Surface" from Parametric Technologies, Inc.

7. Properly Aligning and Orienting Volumes

Once the "cloud point" data has been transferred into "Pro/Surface", the space enclosed by the surfaces is converted into volumes using "Pro/Engineer". For each part scanned, separate volumes are created in this manner. Using the assembly mode of Pro/Engineer, each volume/part is placed in the assembly so as to maximize the overlapped regions.

8. Creating a New Volume that is the Intersection of the Prior Volumes

When all of the volumes have been (positioned) to maximize the overlap, Boolean operations are used to calculate a single volume resulting from the intersection of all other volumes. A software package that can be used to perform the necessary Boolean operations is the ANSYS finite element software.

9. Truncating and Smoothing the Resultant Volume

Next, a software package such as Pro/Engineer is used to truncate and smooth the resultant volume using cuts, radii, and other features until a desirable "one-size-fits-all" shape is obtained which will fit into one side of most ears.

10. Create Uni-Ear Part

The part generated so far would be suitable for one ear only. However, using this part, a mirror image model thereof is generated, again using a program such as Pro/Engineer. This provides mathematical models of two volumes, the original and its mirror image from which a "uni-ear" part can be derived. Once again, using the assembly mode of Pro/Engineer, these two volumes are placed in a new assembly so as to again maximize the overlapped regions. When all of the volumes have been properly positioned, boolean operations, as before, are utilized to calculate a single volume resulting from the intersection of these two volumes.

11. The single volume is then used to create two hollow half-shells having a composite shape in the form of such volume. The two shells when bonded together house the components needed for a functional hearing aid and retain at a distal end a flexible tip with a hollow sound tube which extends toward the tympanic membrane when the hearing aid is inserted into the ear canal.

Figure 5:
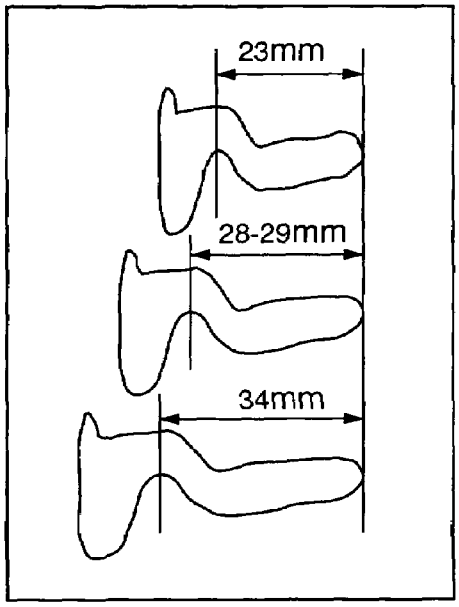
FIG. 5 is a chart of ear canal lengths in mm taken from a number of ear impressions of subjects as measured from the aperture (opening) of the ear canal to the maximum length of the ear impressions.
Figure 6B:
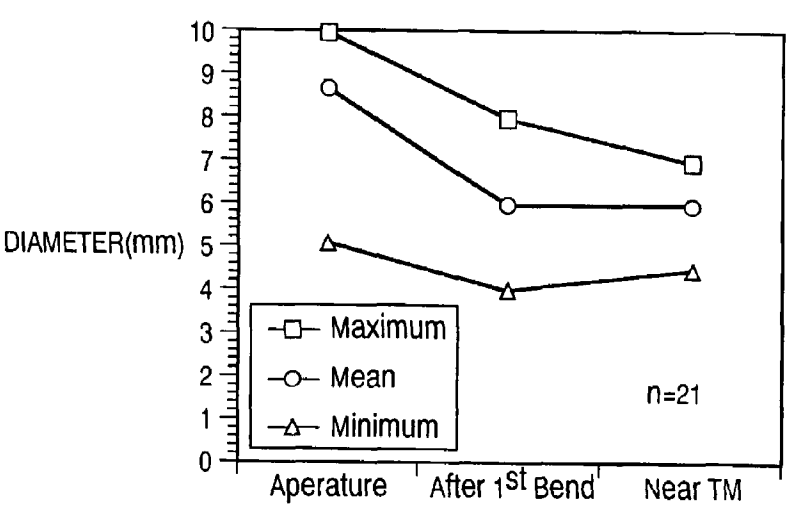
FIG. 6B is a "top view" as in FIG. 6A.
Figure 7B:
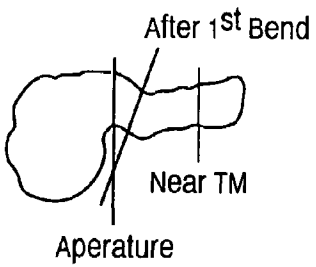
FIG. 7B is an image as in FIG. 7 taken from the top.
Figure 6A:
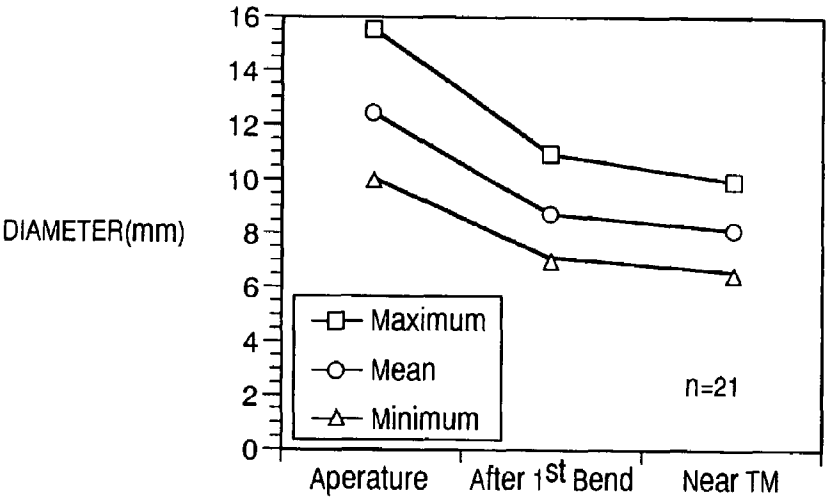
FIG. 6A is a "frontal" view graph of diameter in mm versus the maximum, mean, and minimum diameter taken from ear impressions of a number of subject's versus various critical points in the ear canal, i.e., at the aperture, after the first bend and near the tympanic membrane.
Figure 7A:
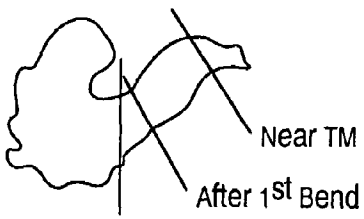
FIG. 7A is a left ear image shown from the front indicating where the sectional diameters are measured.
Figure 8:
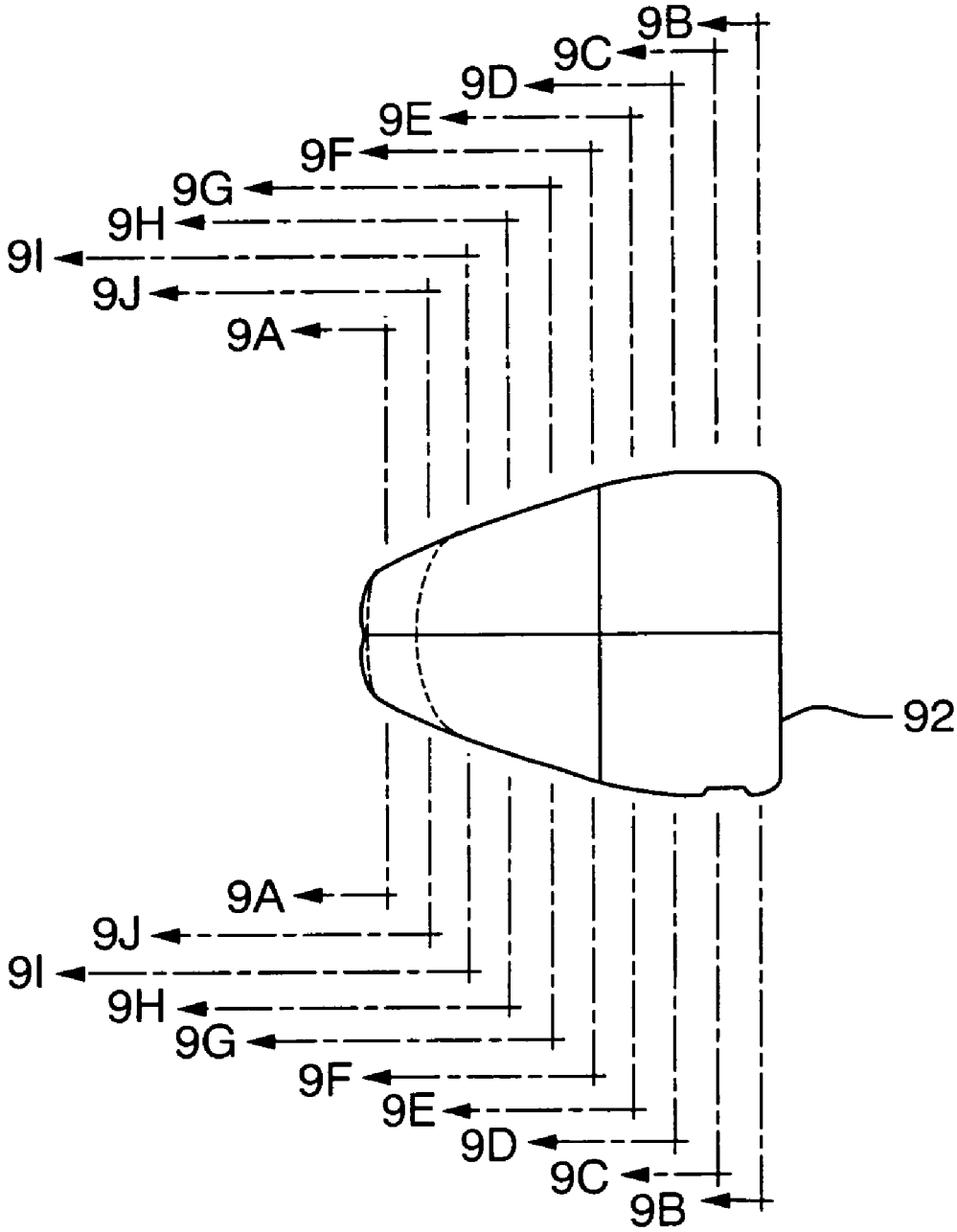
FIG. 8 is a top view of a uni-ear body 92 showing where the sectional views of FIGS. 9A–J are taken.
Figure 9D:
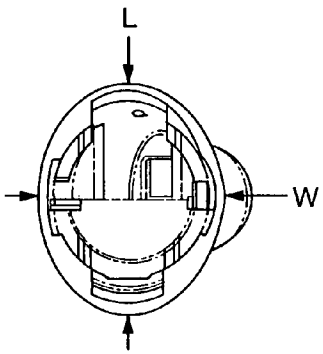
FIGS. 9A–9J are various sectional views of the body 92 of FIG. 8.
Figure 9C:
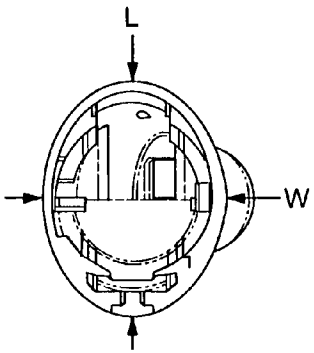
Figure 9B:
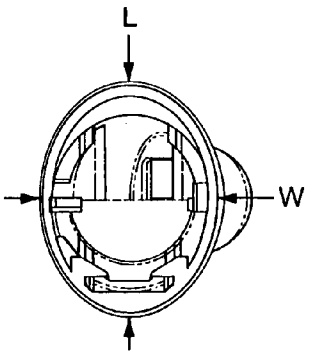
Figure 9G:
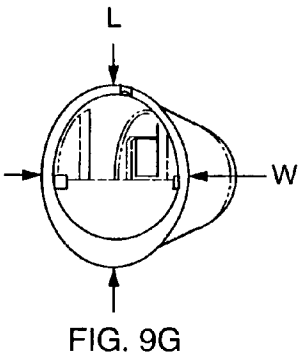
Figure 9F:
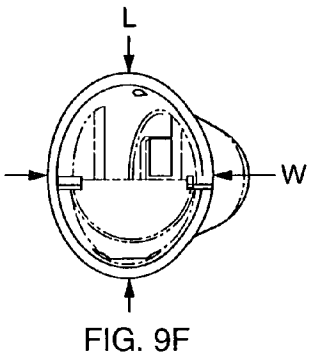
Figure 9E:
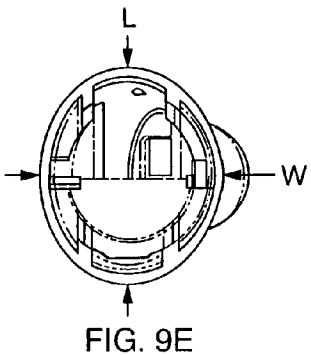
Figure 9J:
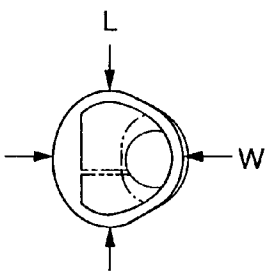
Figure 9I:
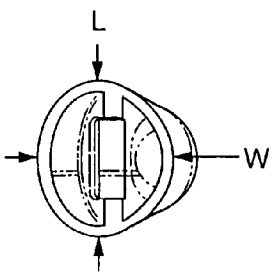
Figure 9H:
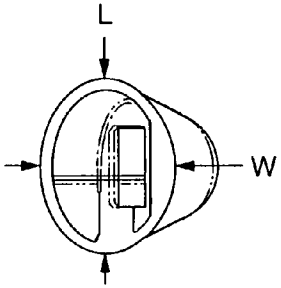
Figure 9A:
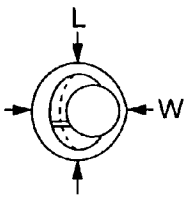

While this invention has been particularly shown and described with references to preferred embodiments thereof, it will be understood by those skilled in the art that various changes in form and details may be made therein without departing from the scope of the invention encompassed by the appended claims. For example, an alternate method of making a "one-size-fits-all" uni-hearing aid body is to measure the canal length and cross-sections of the ear canal at certain critical areas, such as, at the aperture, after the first bend and near the tympanic membrane of a number of impressions taken from subjects; as shown in FIGS. 5, 6A and 6B, respectively. These measurements are then used to create cross-sectional maximum, mean, and minimum dimensions. Using this data, a shell body 92 is generated which has the cross-sectional dimensions shown in FIGS. 9A–9J and the following chart 1 which will accommodate any of the cross-sectional and length dimensions measured from the impressions used to generate the data in FIGS. 5, 6A and 6B.

CHART 1

| FIG. | CROSS-SECTION (inch) "W" | LENGTH (inch) "L" |
|---|---|---|
| 9A | .214 | .228 |
| 9B | .406 | .519 |
| 9C | .418 | .527 |
| 9D | .426 | .523 |
| 9E | .419 | .504 |
| 9F | .385 | .470 |
| 9G | .336 | .429 |
| 9H | .313 | .389 |
| 9I | .315 | .345 |
| 9J | .303 | .295 |

What is claimed is:

1. A Completely in the Canal (CIC) hearing aid body adapted to interchangeably fit inside the ear canal of either a right side or left side of an ear of a typical user such that a distal end of the body is disposed proximally adjacent to a tympanic membrane of said user, the hearing aid body comprising a rigid or semi-rigid shell that is shaped to conform to at least a first bend in an ear canal of a typical user, the shell containing a permanently wired battery and the hearing aid body adapted to be disposable.

2. The body of claim 1 formed of two half shells joined together with hollow interiors for housing hearing aid components.

3. The body of claim 2 in which a soft tip is secured at the distal end of the body.

4. The body of claim 3 wherein the tip includes a sound port for coupling sound from a receiver housed in the body to the membrane of a hearing aid user.

5. A hearing aid body comprising a shell which is shaped to be inserted into and useable inside the ear canal of a right ear or left ear proximal to the tympanic region of a user and which houses the requisite components for a functional hearing aid, the shell comprising a rigid or semi-rigid member that is shaped to conform to at least a first bend in an ear canal of a typical user, the hearing aid components including a permanently wired battery and the hearing aid body is adapted to be disposable.

6. The hearing aid body of claim 5 in which the shell is formed of two halves which are bonded together and wherein a flexible tip is retained at a distal end of the shell.

7. A hearing aid body comprising a shell which is shaped to be inserted into and useable inside the ear canal of a right ear or left ear proximal to the tympanic region of a user and which houses the requisite components for a functional hearing aid, the shell comprising a rigid or semi-rigid member that is shaped to conform to at least a first bend in an ear canal of a typical user, the shell being formed of two halves which are bonded together and wherein a flexible tip is retained at a distal end of the shell; and wherein the components include a permanently wired battery and the hearing aid body is adapted to be disposable.

8. A hearing aid body formed of a rigid or semi-rigid shell enclosing hearing aid components with a flexible tip retained at one end of the shell, the shell having a shape adapted to fit in the ear canal proximal to the tympanic region of either a right or left human ear, the shell being shaped to conform to at least a first bend in an ear canal of a typical user, the shell containing a permanently wired battery and the hearing aid body adapted to be disposable.

9. The hearing aid body of claim 8 in which the tip contains a receiver and a sound tube extending between the receiver and a distal end of the tip.

10. The hearing aid body of claim 8 in which the shell is formed of two half-shells joined together and in which the components include a microphone, and signal processing electronics and a battery permanently wired to the electronics.

* * * * *